US005322296A

United States Patent [19]

Weimerskirch

[11] Patent Number: 5,322,296

[45] Date of Patent: Jun. 21, 1994

[54] TOP GUN DOG FIGHT GAME

[76] Inventor: Ronald W. Weimerskirch, 9956 Flynt Cir., Orlando, Fla. 32825

[21] Appl. No.: 100,428

[22] Filed: Aug. 2, 1993

[51] Int. Cl.[5] ..... A63H 17/02

[52] U.S. Cl. ..... 273/312; 273/85 R; 273/311

[58] Field of Search ..... 273/310-316, 273/85 R, 85 D, 85 G, 85 F

[56] References Cited

U.S. PATENT DOCUMENTS 3,202,425 8/1965 Van Hennik ..... 273/312
3,582,077 6/1971 Parker ..... 273/316
3,724,854 4/1973 Brooks et al. ..... 273/311
4,810,224 3/1989 DeVincent ..... 273/313 X
4,938,483 7/1990 Yavetz ..... 273/311
5,169,156 12/1992 Smollar ..... 273/312

*Primary Examiner*—Vincent Millin
*Assistant Examiner*—Kerry Owens
*Attorney, Agent, or Firm*—Michael I. Kroll

[57] ABSTRACT

A top gun dog fight game is provided and consists of three basic components, being a game board, a pair of continuous tracks suspended above the game board and model aircraft which move in opposite directions along the tracks. Each player tries to disable both the opponents players ground weapons on the game board and all the model aircraft on the respective track, so as to determine who will become the top gun at the end of the game.

16 Claims, 4 Drawing Sheets

TOP GUN DOG FIGHT GAME

BACKGROUND OF THE INVENTION

1. Field of the Invention

The instant invention relates generally to electronic games and more specifically it relates to a top gun dog fight game.

2. Description of the Prior Art

Numerous electronic games have been provided in prior art that are adapted to entertain people who participate in operating and playing the electronic games. While these units may be suitable for the particular purpose to which they address, they would not be as suitable for the purposes of the present invention as heretofore described.

SUMMARY OF THE INVENTION

A primary object of the present invention is to provide a top gun dog fight game that will overcome the shortcomings of the prior art devices.

Another object is to provide a top gun dog fight game that is a combination board game, race track and video game which will simulate a real aircraft dog fight, so as to determine the player who will become the top gun at the end of the game.

An additional object is to provide a top gun dog fight game that consists of three basic components, being a game board, a pair of continuous tracks suspended above the game board and model aircraft which move along the tracks, whereby each player tries to disable both the opponent player's ground weapons on the game board and all the model aircraft on the track.

A further object is to provide a top gun dog fight game that is simple and easy to use.

A still further object is to provide a top gun dog fight game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
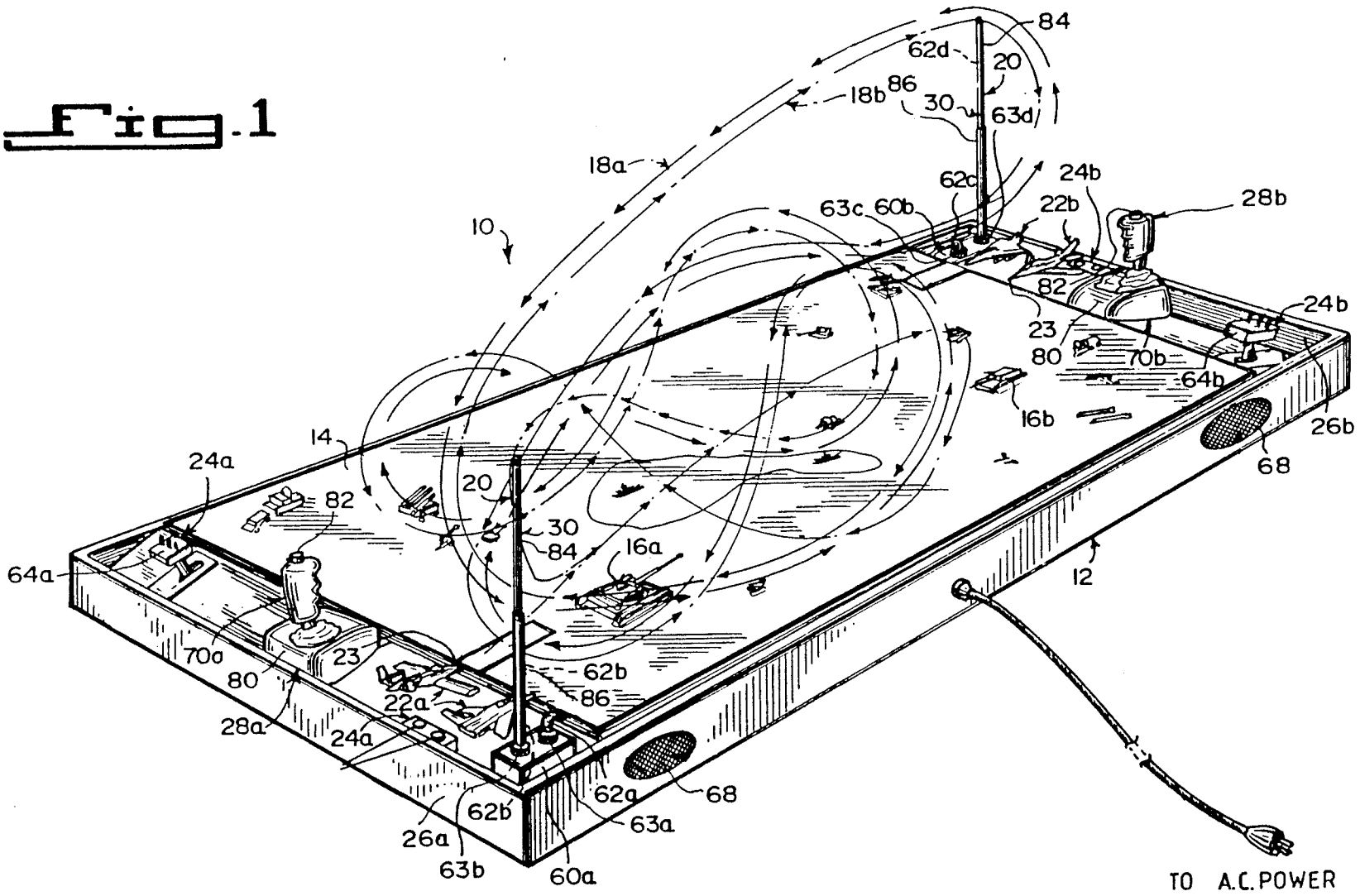
FIG. 1 is a perspective view of the instant invention showing the track paths in phantom.

Turning now descriptively to the drawings, in which similar reference characters denote similar elements throughout the several views, FIGS. 1 through 5 illustrate a top gun dog fight game 10 which consists of a game board 12 having a playing field 14 divided into two opposite areas. Two sets of ground weapons **16*a*, 16*b* are provided. Each set of ground weapons 16*a*, 16*b* are located upon one area of the playing field 14. Two continuous tracks 18*a*, 18*b* are also provided, with structures 20 for suspending the tracks 18*a*, 18*b* above the playing field 14. Two set of model aircraft 22*a*, 22*b* are provided, having weapons 23, wherein each said set of model aircraft can move along each said respective track. An apparatus 24*a* on a first side 26*a* of the game board 12 is for firing the first set of ground weapons 16*a* by a first player. A device 28*a* on the first side 26*a* of the game board is for moving the first set of model aircraft 22*a* in one direction along the first track 18*a* and for firing the aircraft weapons 23 by the first player. An apparatus 24*b* on a second side 26*b* of the game board 12 is for firing the second set of ground weapons 16*b* by a second player. A device 28*b* on the second side 26*b* of the game board 12 is for moving the second set of model aircraft 22*b* in an opposite direction along the second track 18*b* and for firing the aircraft 23** weapons by the second player. To win the game one of the players must disable all of the opponents players ground weapons and model aircraft.

Figure 1A:
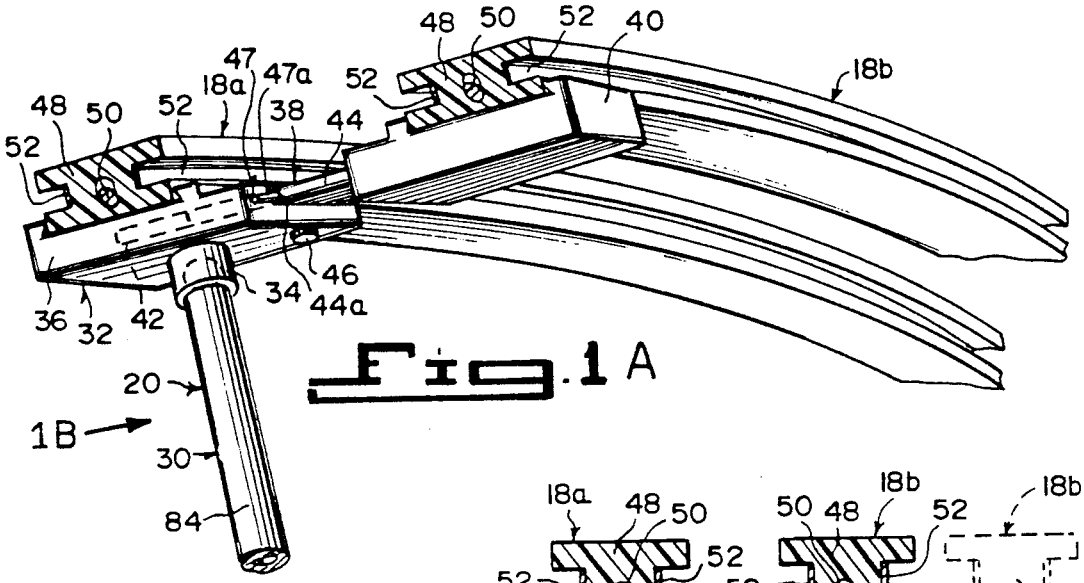
FIG. 1A is a perspective view of a portion of the tracks showing one of the track supports and adjustable spacing structures for the clamp.
Figure 1B:
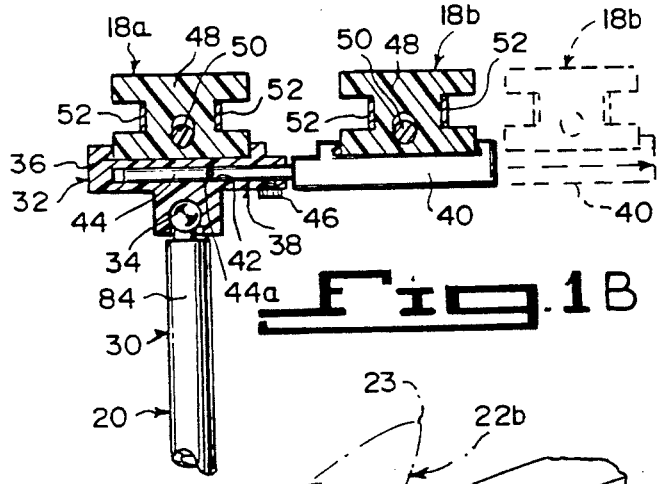
FIG. 1B is an elevational view partly in cross section taken in direction of arrow 1B in FIG. 1A.
Figure 1C:
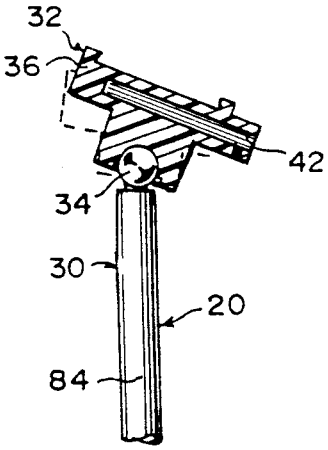
FIG. 1C is an elevational view partly in cross section of the track support showing the clamp pivoted for track banking.

The tracks suspending structure 20, as best seen in FIGS. 1A, 1B and 1C include a plurality of support posts 30 mounted vertically to the game board 12 in spaced apart relationships and a plurality of bracket assemblies 32. Each bracket assembly 32 is located on a top end of each support post 30, for engagement with the tracks **18*a*, 18*b*. Each bracket assembly 32 includes a ball and socket joint 34 on the top end of the support post 30, so that the bracket assembly 32** can be pivoted for track banking.

Each bracket assembly 32 further contains a first clamp 36 mounted to the ball and socket joint 34, for engagement with the first track **18*a*. An adjustable spacing structure 38 extends from a side of the first clamp 36. A second clamp 40 is connected to the adjustable spacing structure 38 for engagement with the second track 18*b*. The adjustable spacing structure 38 can move the second track 18*b* away and towards the first track 18*a***.

The adjustable spacing structure 38 includes the first clamp 36 having a slot 42 extending inwardly form the side thereof. A tongue 44 extends outwardly from a facing side of the second clamp 40, so as to slide within the slot 42 in the first clamp 36. A set screw 46 is threaded from the underside of the first clamp 36 to the slot 42, so that the set screw 46 can contact the tongue 44 transversely to hold the tongue 44 in a stationary position.

The adjustable spacing structure 38 further contains a stopping mechanism 47, to prevent the tracks 18*a*, 18*b* from adjusting too close together, so that the wings of the model aircraft 22*a*, 22*b* will not collide when passing each other. The stopping mechanism consists of the tongue 44, 44*a* having a side aperture therein located about midway the distance. A pin 47*a* is removably placed into the side aperture 44*a*, so that a portion of the pin 47*a* will extend therefrom, to prevent total insertion of the tongue 44 into the slot 42 in the first clamp 36.

Each track 18*a*, 18*b* contains a plastic I-beam configuration 48. A metal rod 50 extends through a center portion of the plastic I-beam configuration 48 for strength and a pair of metal conductive rails 52 are each located vertically on opposite sides of the center portion of the plastic I-beam configuration 48, to supply electric current therealong.

Figure 1D:
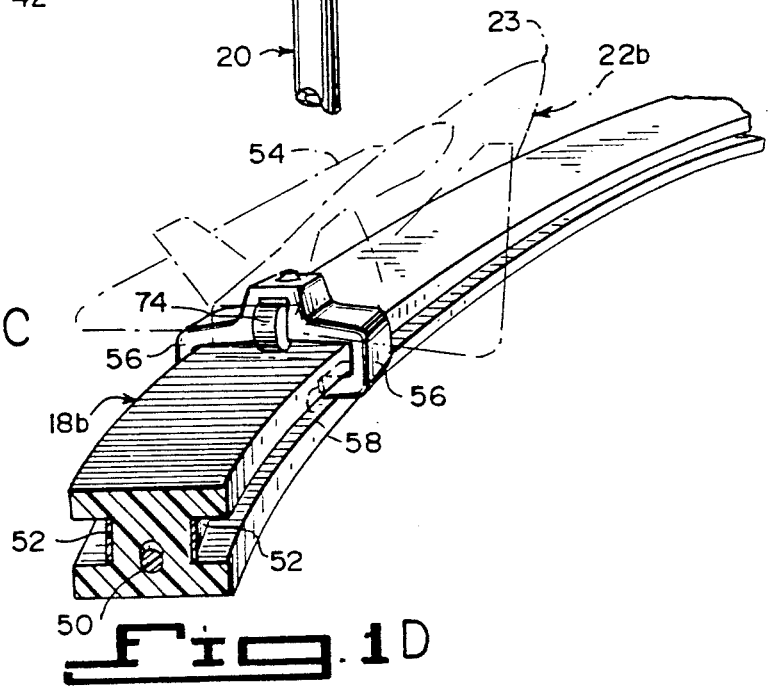
FIG. 1D is a perspective view of a portion of one track showing one of the model aircraft thereon partly in phantom.

As best seen in FIG. 1D, each model aircraft 22*a*, 22*b* includes a fuselage 54 and a pair of guide arms 56. Each guide arm 56 extends downwardly from the fuselage 54 and towards one rail 52. An electrical brush 58 is located on a distal end of each guide arm 56, to make electrical contact with the rail 52, so as to carry electrical power into the model aircraft 22*a*, 22*b*, as the model aircraft moves along the track 18*a*, 18*b*.

The first firing apparatus 24*a* for the first set of ground weapons 16*a*, consists of a first transformer module 60*a* mounted in the first side 26*a* of the game board 12 and is electrically connected to an AC power source. A first power supply conduit 62*a* is removably coupled by connector 63*a* to the first transformer module 60*a* and extends into the playing field 14 of the game board 12. A first round weapons control 64*a* is mounted in the first side 26*a* of the game board 12 and is electrically connected to the first power supply conduit 62*a* and the first set of ground weapons 16*a*. A sound effects generator 66 is electrically connected to the first ground weapons control 64*a*. Speakers 68 are electrically connected to the sound effects generator 66.

The first moving and firing device 28*a* for the first set of model aircraft 22*a* includes one support post 30 being hollow and having a second power supply conduit 62*b* removably coupled by connector 63*b* to the first transformer module 60*a*, so that the second power supply conduit 62*b* will be electrically connected to the pair of rails 52 in the first track 18*a*. A first aircraft propulsion and weapons control 70*a* is electrically connected to the first power supply conduit 62*a*, the pair of rails 52 in the first track 18*a* and the sound effects generator 66.

The second firing apparatus 24*b* for the second set of ground weapons 16*b* consists of a second transformer module 60*b* mounted in the second side 26*b* of the game board 12 and is electrically connected to the AC power source. A third power supply conduit 62*c* is removably coupled by connector 63*c* to the second transformer module 60*b* and extends into the playing field 14 of the game board 12. A second ground weapons control 64*b* is mounted in the second side 26*b* of the game board 12, and is electrically connected to the third power supply conduit 62*c* and also the second set of ground weapons 16*b*. The second ground weapons control 64*b* is electrically connected to the sound effects generator 66.

The second moving and firing device 28*b* for the second set of model aircraft 22*b* includes another support post 30 being hollow and having a fourth power supply conduit 62*d* removably coupled by connector 63*d* to the second transformer module 60*d*. The fourth power supply conduit 62*d* will be electrically connected to the pair of rails 52 in the second track 18*b*. A second aircraft propulsion and weapons control 70*b* is electrically connected to the third power supply conduit 62*c*, the pair of rails 52 in the second track 18*b* and the sound effects generator 66.

Figure 5:
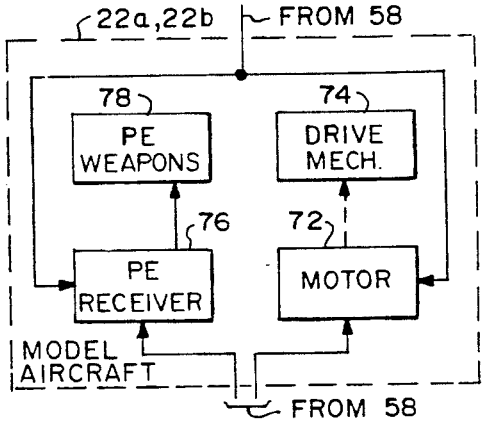
FIG. 5 is a block diagram showing the electronic components in one of the aircraft propulsion and weapons circuits of FIG. 4.
Figure 4:
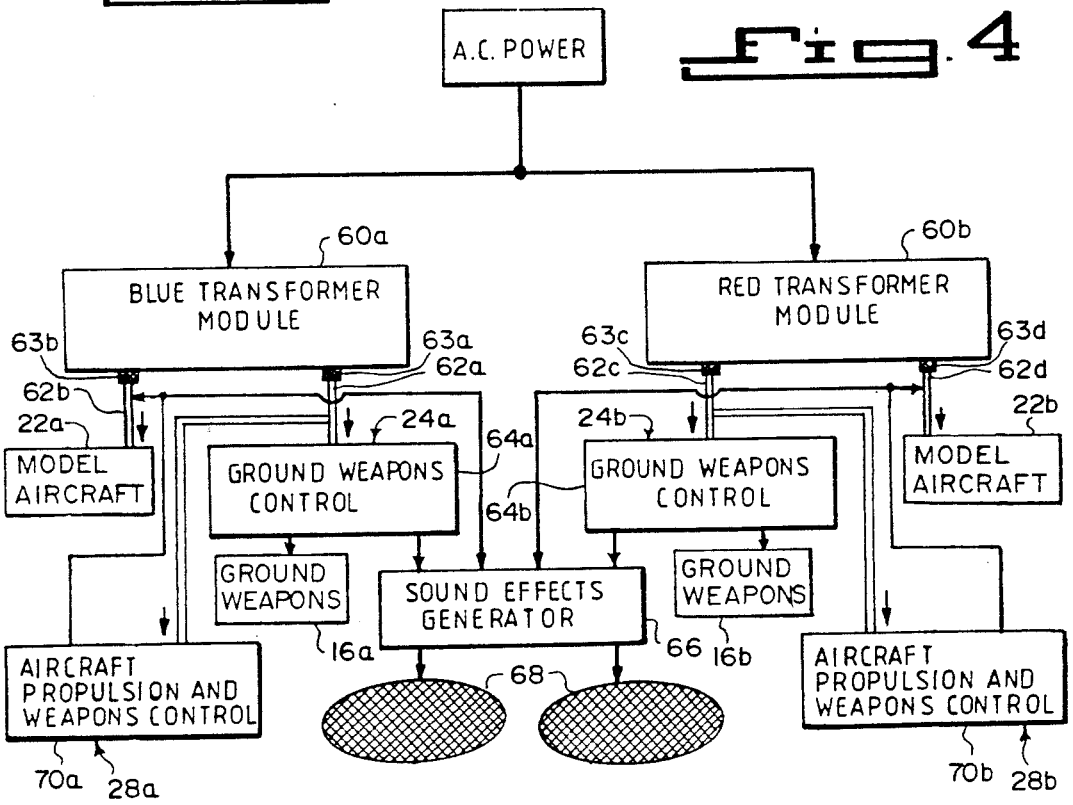
FIG. 4 is a block diagram showing the electronic components of the game.

As shown in FIG. 5, each model aircraft 22*a*, 22*b* includes a motor 72 electrically connected to the first electrical brush 58, to receive power from the respective transformer module 60*a*, 60*b* and is electrically connected to the second electrical brush 58, to be operated by the respective aircraft propulsion and weapons control 70*a*, 70*b*. A drive mechanism 74 is driven by the motor 52, so that the model aircraft 22*a*, 22*b* can move along the track 18*a*, 18*b*. A photo electric receiver 76 is electrically connected to the first electrical brush 58, to receive power from the respective transformer module 60*a*, 60*b* and is electrically connected to the second electrical brush 58 to receive a signal from the respective aircraft propulsion and weapons control 70*a*, 70*b*. A photo electric weapon 78 is electrically connected to the photo electric receiver 56 which will fire when activated.

Each first and second aircraft propulsion and weapons control 70*a*, 70*b* can be a joy stick 80 having a firing button 82 thereon.

Figure 2:
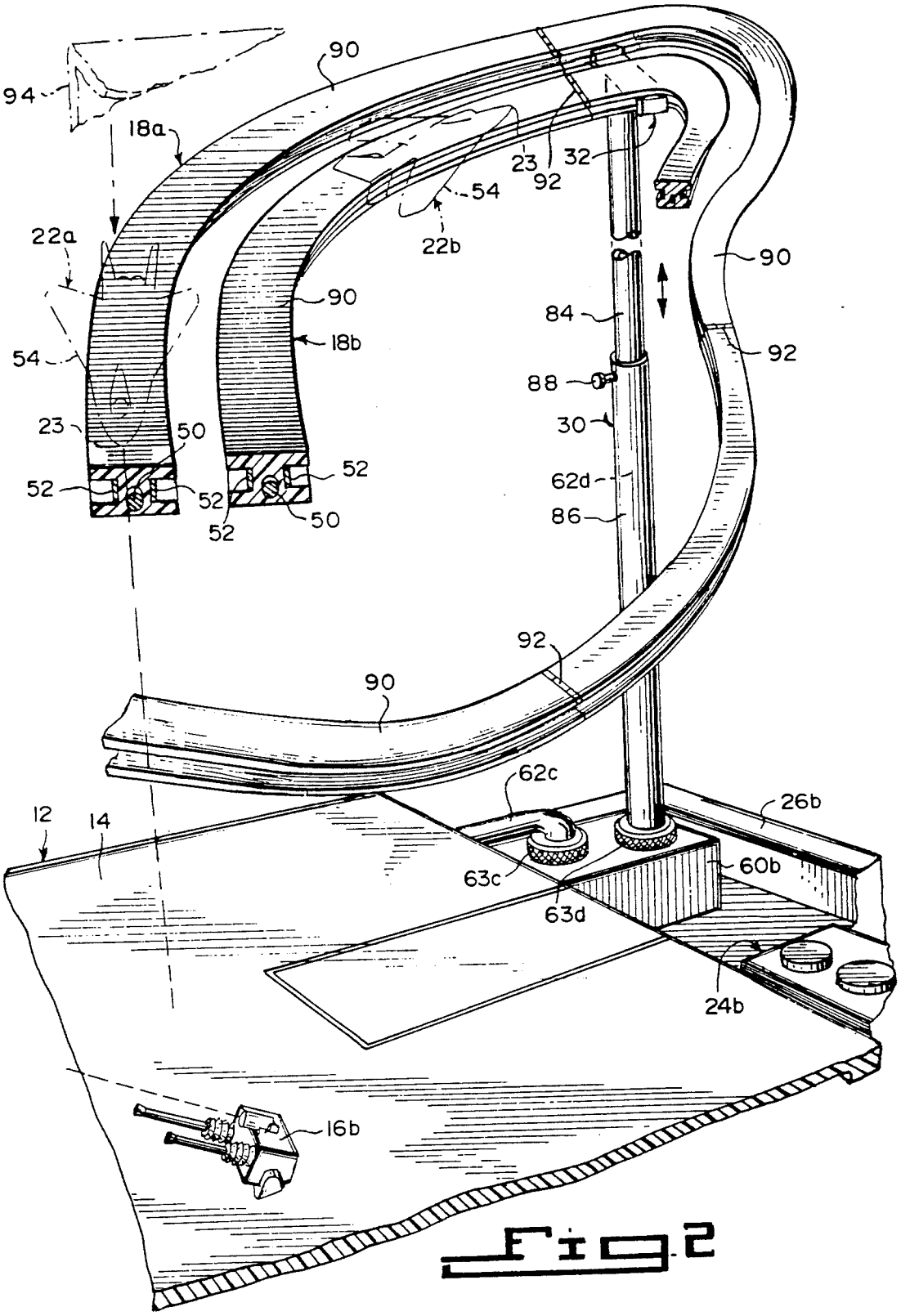
FIG. 2 is an enlarged perspective view of a portion of the instant invention showing the tracks suspended on one of the track supports.
Figure 3:
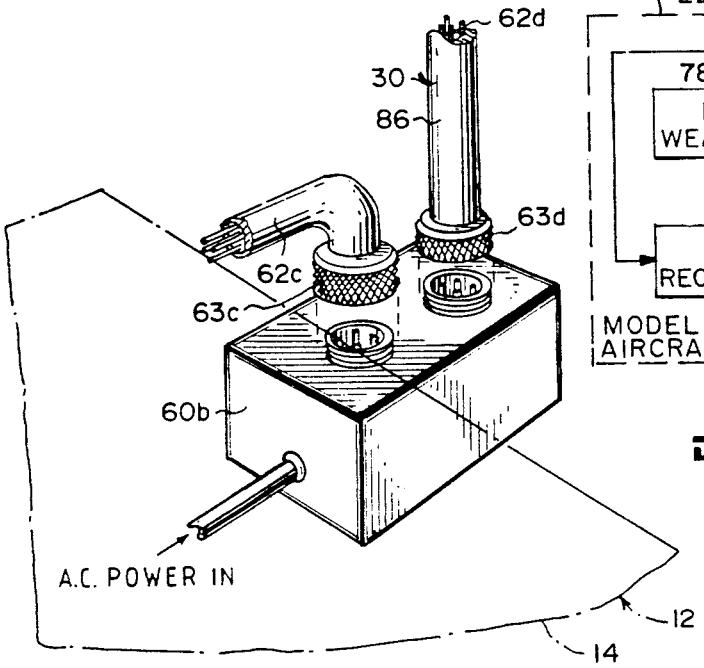
FIG. 3 is an enlarged perspective view with parts exploded and in phantom showing one of the transformer modules in greater detail.

As best shown in FIG. 2, each support post 30 has an upper portion 72 which slides into a lower portion 74, so as to be collapsible. A setscrew 76 is threaded into the lower portion 74, to engage with the upper portion 72, so as to retain the upper portion 72 in a stationary position. The tracks 18*a*, 18*b* are divided into segmented sections 78 and have a plurality of hinges 80, each located between two segmented sections 78 of each track 18*a*, 18*b*, so that the tracks can be folded for storage. A cover 82, shown in phantom, fits over the game board 12.

LIST OF REFERENCE NUMBERS

10: top gun dog fight game
12: game board
14: playing field on 12
16*a*: first ground weapon
16*b*: second ground weapon
18*a*: first track
18*b*: second track
20: track suspending structure
22*a*: first model aircraft
22*b*: second model aircraft
23: weapons on 22*a*, 22*b*
24*a*: first firing apparatus
24*b*: second firing apparatus
26*a*: first side of 12
26*b*: second side of 12
28*a*: first moving and firing device
28*b*: second moving and firing device
30: support post
32: bracket assembly
34: ball and socket joint
36: first clamp
38: adjustable spacing structure
40: second clamp
42: slot in 36
44: tongue on 40
44*a*: side aperture in 44
46: setscrew
47: stopping mechanism
47*a*: pin
48: plastic I-beam configuration

50: metal rod in 48
52: metal conductive rail
54: fuselage
56: guide arm
58: electrical brush on 56
60*a*: first transformer module
60*b*: second transformer module
62*a*: first power supply conduit
62*b*: second power supply conduit in 30
62*c*: third power supply conduit
62*d*: fourth power supply conduit in 30
63*a*: first connector on 62*a*
63*b*: second connector on 62*b*
63*c*: third connector on 62*c*
63*d*: fourth connector on 62*d*
64*a*: first ground weapons control
64*b*: second ground weapons control
66: sound effects generator
68: speaker
70*a*: first aircraft propulsion and weapons control
70*b*: second aircraft propulsion and weapons control
72: motor
74: drive mechanism
76: photo electric receiver
78: photo electric weapon
80: joy stick
82: firing button
84: upper portion of 30
86: lower portion of 30
88: setscrew
90: segmented sections for 18*a*, 18*b*
92: hinge
94: cover It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A top gun dog fight game which comprises:

a) a game board having a playing field divided into two opposite areas;

b) two sets of ground weapons, each said set of ground weapons located upon one area of said playing field;

c) two continuous tracks;

d) means for suspending said tracks above said playing field;

e) two sets of model aircraft having weapons, wherein each said set of model aircraft can move along each said respective track;

f) means on a first side of said game board for firing said first set of ground weapons by a first player;

g) means on the first side of said game board for moving said first set of model aircraft in one direction along said first track and for firing said aircraft weapons by the first player; p1 h) means on a second side of said game board for firing said second set of ground weapons by a second player; and i) means on the second side of said game board for moving said second set of model aircraft in an opposite direction along said second track and for firing said aircraft weapons by the second player, whereby to win the game one of the players must disable all of the opponents players ground weapons and model aircraft.

2. A top gun dog fight game as recited in claim 1, wherein said tracks suspending means includes:

a) a plurality of support posts mounted vertically to said game board in spaced apart relationships; and b) a plurality of bracket assemblies, each located on a top end of each said support post for engagement with said tracks.

3. A top gun dog fight game as recited in claim 2, wherein each said bracket assembly includes a ball and socket joint on the top end of said support post, so that said bracket assembly can be pivoted for track banking.

4. A top gun dog fight game as recited in claim 3, wherein each said bracket assembly further includes:

a) a first clamp mounted to said ball and socket joint for engagement with said first track;

b) an adjustable spacing structure extending from a side of said first clamp; and c) a second clamp connected to said adjustable spacing structure for engagement with said second track, whereby said adjustable spacing structure can move said second track away and towards said first track.

5. A top gun dog fight game as recited in claim 4, wherein said adjustable spacing structure includes:

a) said first clamp having a slot extending inwardly from the side thereof;

b) a tongue extending outwardly from a facing side of said second clamp, so as to slide within said slot in said first clamp; and c) a setscrew threaded from the underside of said first clamp to said slot, so that said setscrew can contact said tongue transversely to hold said tongue in a stationary position.

6. A top gun dog fight game as recited in claim 5, wherein said adjustable spacing structure further includes a stopping mechanism to prevent said tracks from adjusting too close together, so that the wings of said model aircraft will not collide when passing each other.

7. A top gun dog fight game as recited in claim 6, wherein said stopping mechanism includes:

a) said tongue having a side aperture therein located about midway the distance; and b) a pin removably placed into said side aperture, so that a portion of said pin will extend therefrom to prevent total insertion of said tongue into said slot in said first clamp.

8. A top gun dog fight game as recited in claim 7, wherein each said track includes:

a) a plastic I-beam configuration;

b) a metal rod extending through a center portion of said plastic I-beam configuration for strength; and c) a pair of metal conductive rails, each located vertically on opposite sides of the center portion of said plastic I-beam configuration to supply electric current therealong;

9. A top gun dog fight game as recited in claim 8, wherein each said model aircraft includes:

a) a fuselage;

b) a pair of guide arms, each extending downwardly from said fuselage and towards one said rail; and c) a pair of electrical brushes, each located on a distal end of one said guide arms to make electrical contact with said rail, so as to carry electrical power into said model aircraft as said model aircraft moves along said track.

10. A top gun dog fight game as recited in claim 9, wherein said first firing means for said first set of ground weapons includes:

a) a first transformer module mounted in the first side of said game board and electrically connected to an AC power source;

b) a first power supply conduit removably coupled to said first transformer module, and extends into said playing field of said game board;

c) a first ground weapons control mounted in the first side of said game board, electrically connected to said first power supply conduit and said first set of ground weapons;

d) a sound effects generator electrically connected to said first ground weapons control; and e) speakers electrically connected to said sound effects generator.

11. A top gun dog fight game as recited in claim 10, wherein said first moving and firing means for said first set of model aircraft includes:

a) one said support post being hollow and having a second power supply conduit removably coupled to said first transformer module, so that said second power supply conduit will be electrically connected to said pair of rails in said first track; and b) a first aircraft propulsion and weapons control electrically connected to said first power supply conduit, said pair of rails in said first track and said sound effects generator.

12. A top gun dog fight game as recited in claim 9, wherein said second firing means for said second set of ground weapons includes:

a) a second transformer module mounted in the second side of said game board and electrically connected to the AC power source;

b) a third power supply conduit removably coupled to said second transformer module and extends into said playing field of said game board;

c) a second ground weapons control mounted in the second side of said game board, electrically connected to said third power supply conduit and said second set of ground weapons, whereby said second ground weapons control is electrically connected to said sound effects generator.

13. A top gun dog fight game as recited in claim 12, wherein said second moving and firing means for said second set of model aircraft includes:

a) another said support post being hollow and having a fourth power supply conduit removably coupled to said second transformer module, so that said fourth power supply conduit will be electrically connected to said pair of rails in said second track; and b) a second aircraft propulsion and weapons control electrically connected to said third power supply conduit, said pair of rails in said second track and said sound effects generator.

14. A top gun dog fight game as recited in claim 13, wherein each said model aircraft includes:

a) a motor electrically connected to said first electrical brush to receive power from said respective transformer module and electrically connected in said second electrical brush to be operated by said respective aircraft propulsion and weapons control;

b) a drive mechanism driven by said motor, so that said model aircraft can move along said track;

c) a photo electric receiver electrically connected to said first electrical brush to receive power from said respective transformer module and electrically connected to said second electrical brush, to receive a signal from said respective aircraft propulsion and weapons control; and d) a photo electric weapon electrically connected to said photo electric receiver which will fire when activated.

15. A top gun dog fight game as recited in claim 14, wherein each said first and second aircraft propulsion and weapons control is a joy stick having a firing button thereon.

16. A top gun dog fight game as recited in claim 15, further including:

a) each said support post having an upper portion which slides into a lower portion, so as to be collapsible;

b) a setscrew threaded into said lower portion to engage with said upper portion, so as to retains aid upper portion in a stationary position;

c) said tracks being divided into segmented sections and having a plurality of hinges, each located between two segmented sections of each said track, so that said tracks can be folded for storage; and d) a cover to fit over said game board.

* * * * *